US012035834B1

(12) United States Patent
Song

(10) Patent No.: US 12,035,834 B1
(45) Date of Patent: Jul. 16, 2024

(54) CONNECTING ROD PIECE

(71) Applicant: Yong Song, Hangzhou (CN)

(72) Inventor: Yong Song, Hangzhou (CN)

( * ) Notice: Subject to any disclaimer, the term of this patent is extended or adjusted under 35 U.S.C. 154(b) by 0 days.

(21) Appl. No.: 18/404,249

(22) Filed: Jan. 4, 2024

(30) Foreign Application Priority Data

Dec. 29, 2023 (CN) ..... 202323647370.8

(51) Int. Cl.
*A47H 1/02* (2006.01)

(52) U.S. Cl.
CPC ..... *A47H 1/02* (2013.01)

(58) Field of Classification Search
CPC . A47H 13/02; A47H 1/02; A47H 5/06; A47H 2001/0215; F16B 7/0413
See application file for complete search history.

(56) References Cited

U.S. PATENT DOCUMENTS 4,006,770 A * 2/1977 Ferguson ..... E06B 9/17 160/405
5,474,501 A * 12/1995 Teng ..... A63J 11/00 403/311
5,613,543 A * 3/1997 Walton ..... E04G 21/28 160/265
6,418,949 B1 * 7/2002 Lin ..... A45B 19/04 135/25.1
6,554,235 B1 * 4/2003 Fortier ..... A47B 91/02 248/200.1
8,024,908 B2 * 9/2011 Williams ..... E04H 12/02 D25/123
10,053,909 B2 * 8/2018 Wang ..... E06B 9/44
11,773,888 B2 * 10/2023 Moss ..... A47H 1/022 29/525.11
2008/0110582 A1 * 5/2008 Rasmussen ..... E06B 9/44 160/263
2016/0237743 A1 * 8/2016 Holt ..... E06B 9/56
2021/0381537 A1 * 12/2021 Mullet ..... A47H 13/02

* cited by examiner

*Primary Examiner* — Ko H Chan

(57) ABSTRACT

The present disclosure provides a connecting rod piece, including a hollow first connecting rod unit, a connection device and a hollow second connecting rod unit. A side wall of the first connecting rod unit is provided with a first mounting slot. A side wall of the second connecting rod unit is provided with a second mounting slot. The second connecting rod unit is detachably connected to the first connecting rod unit through the connecting device, and the first mounting slot and the second mounting slot are communicated in sequence to form a mounting channel. And the mounting channel is configured to mount a curtain.

17 Claims, 12 Drawing Sheets

CONNECTING ROD PIECE

CROSS-REFERENCE TO RELATED APPLICATIONS

The application claims priority of Chinese patent application CN2023236473708, filed on Dec. 29, 2023, which is incorporated herein by reference in its entireties.

TECHNICAL FIELD

The present disclosure relates to the technical field of curtains, and in particular, to a connecting rod piece.

BACKGROUND

There are curtains and connecting rod pieces for curtains currently available on the market, and the connecting rod pieces are all integrally formed, so the connecting rod pieces are relatively long, which are inconvenient for transportation and mounting, causing high transportation and mounting costs and great troubles. Therefore, there is an urgent need to provide a connecting rod piece that is convenient to mount and transport on the market to improve the user experience.

SUMMARY

In order to overcome the shortcomings of the prior art, the present disclosure provides a connecting rod piece, including:

a hollow first connecting rod unit, wherein a side wall of the first connecting rod unit is provided with a first mounting slot;

a connection device; and a hollow second connecting rod unit, wherein a side wall of the second connecting rod unit is provided with a second mounting slot; the second connecting rod unit is detachably connected to the first connecting rod unit through the connecting device, and the first mounting slot and the second mounting slot are communicated in sequence to form a mounting channel; and the mounting channel is configured to mount a curtain.

As the improvement of the present disclosure, the first connecting rod unit has a first mounting opening; the second connecting rod unit has a second mounting opening; the connecting device includes a connecting pipe fitting; and one end of the connecting pipe fitting is inserted into the first mounting opening, and the other end of the connecting pipe fitting is inserted into the second mounting opening, to enable the connecting pipe fitting to combine the first connecting rod unit with the second connecting rod unit into a whole.

As the improvement of the present disclosure, the connecting device further includes a locking member; and when one end of the connecting pipe fitting is inserted into the first mounting opening, and the other end of the connecting pipe fitting is inserted into the second mounting opening, to enable the connecting pipe fitting to combine the first connecting rod unit with the second connecting rod unit into a whole, the locking member locks the first connecting rod unit to the second connecting rod unit.

As the improvement of the present disclosure, the locking member includes a first locking slot, a second locking slot, a locking gasket, a first adjustment member, and a second adjustment member; an end portion of the first locking slot is provided with a first insertion port; an end portion of the second locking slot is provided with a second insertion port; when one end of the connecting pipe fitting is inserted into the first mounting opening, and the other end of the connecting pipe fitting is inserted into the second mounting opening, to enable the connecting pipe fitting to combine the first connecting rod unit with the second connecting rod unit into a whole, one end of the locking gasket is inserted into the first locking slot through the first insertion port, and the other end of the locking gasket is inserted into the second locking slot through the second insertion port; and the first adjustment member compresses and locks one end of the locking gasket in the first locking slot, and the second adjustment member compresses and locks the other end of the locking gasket in the second locking slot, so as to lock the first connecting rod unit in the second connecting rod unit.

As the improvement of the present disclosure, the first adjustment member includes a first adjustment screw and a first adjustment screw hole; the second adjustment member includes a second adjustment screw and a second adjustment screw hole; the first adjustment screw hole is arranged at one end of the locking gasket, and the second adjustment screw hole is arranged the other end of the locking gasket; when one end of the connecting pipe fitting is inserted into the first mounting opening, and the other end of the connecting pipe fitting is inserted into the second mounting opening, to enable the connecting pipe fitting to combine the first connecting rod unit with the second connecting rod unit into a whole, one end of the locking gasket is inserted into the first locking slot via the first insertion port, and the other end of the locking gasket is inserted into the second locking slot through the second insertion port; one end of the first adjustment screw moves inside the first adjustment screw hole to compress an inner wall of the first locking slot, so that the other end of the first adjustment screw compresses and locks one end of the locking gasket against the inner wall of the first locking slot; and one end of the second adjustment screw moves inside the second adjustment screw hole to compress an inner wall of the second locking slot, so that the other end of the second adjustment screw compresses and locks the other end of the locking gasket against the inner wall of the second locking slot, so as to lock the first connecting rod unit to the second connecting rod unit.

As the improvement of the present disclosure, the first connecting rod unit has a first inner surface and a first outer surface; the first outer surface is recessed towards the first inner surface to form the first mounting slot and the first locking slot on the first outer surface and to form a first guide protrusion opposite to the first mounting slot and a second guide protrusion opposite to the first locking slot on the first inner surface; the second connecting rod unit has a second inner surface and a second outer surface; the second outer surface is recessed towards the second inner surface to form the second mounting slot and the second locking slot on the second outer surface and to form a third guide protrusion opposite to the second mounting slot and a fourth guide protrusion opposite to the second locking slot on the second inner surface; the connecting pipe fitting is provided with a first guide slot and a second guide slot; the first guide slot is connected to the first guide protrusion and the third guide protrusion; and the second guide slot is connected to the second guide protrusion and the fourth guide protrusion.

As the improvement of the present disclosure, a stop protrusion is further arranged on a side wall of the connecting pipe fitting; one side of the stop protrusion is stopped at the first mounting opening; and the other side of the stop protrusion is stopped at the second mounting opening.

As the improvement of the present disclosure, a first stop edge is arranged on the first locking slot; when one end of the locking gasket is inserted into the first locking slot, the first stop edge stops the locking gasket in the first locking slot; a second stop edge is arranged on the second locking slot; and when the other end of the locking gasket is inserted into the second locking slot, the second stop edge stops the locking gasket in the second locking slot.

As the improvement of the present disclosure, the first locking slot and the first mounting slot both extend from one end of the first connecting rod unit to the other end of the first connecting rod unit, and the second locking slot and the second mounting slot both extend from one end of the second connecting rod unit to the other end of the second connecting rod unit.

As the improvement of the present disclosure, the connecting rod piecefurther includes the curtain, wherein a third insertion port is arranged at an end portion of the first mounting slot and/or an end portion of the second mounting slot; the curtain has a shading part and a mounting bar; the shading part is connected to the mounting bar; the mounting bar is placed into the mounting channel through the first mounting slot, the first guide slot, and the second mounting slot through the third insertion port in sequence; a first avoidance notch is arranged in axial directions of the first mounting slot, the first guide slot, and the second mounting slot; and the first avoidance notch is configured to avoid the shading part.

As the improvement of the present disclosure, an upper side of the shading part is connected to the shading part after being bent to form an accommodating chamber, and the mounting bar is arranged in the accommodating chamber.

As the improvement of the present disclosure, the shading part is a flexible shading part, and the mounting bar is a flexible mounting bar.

As the improvement of the present disclosure, the connecting rod piece further includes an end cover, wherein the end cover is detachably covered at the third insertion port.

As the improvement of the present disclosure, a narrow slot is formed between the first guide protrusion and the second guide protrusion, and the end cover is provided with a convex block; and when the end cover is detachably covered at the third insertion port, the convex block is inserted into the narrow slot.

As the improvement of the present disclosure, a second avoidance notch is arranged in axial directions of the first locking slot and the second locking slot, and the second avoidance notch is configured to avoid the first adjustment screw and the second adjustment screw.

As the improvement of the present disclosure, a quantity of the first locking slot is at least two, and the at least two first locking slots and the first mounting slot are uniformly arranged in sequence in a circumferential direction around a side wall of the first connecting rod unit; a quantity of the second locking slot is at least two, and the at least two second locking slots and the second mounting slot are uniformly arranged in sequence in a circumferential direction around a side wall of the second connecting rod unit; a quantity of the locking gasket is at least two; one end of each of the at least two locking gaskets is arranged in each of the at least two first locking slots; and the other ends of the at least two locking gaskets are respectively arranged in the at least two second locking slots.

As the improvement of the present disclosure, cross sections of the first locking slot and the second locking slot are square, and cross sections of the first mounting slot and the second mounting slot are circular.

As the improvement of the present disclosure, the connecting pipe fitting is a plastic connecting pipe fitting or a metal connecting pipe fitting.

As the improvement of the present disclosure, the first connecting rod unit is a first metal connecting rod unit, and the second connecting rod unit is a second metal connecting rod unit.

As the improvement of the present disclosure, the end cover is a plastic end cover or a metal end cover.

Beneficial effects of the present disclosure are as follows: Through the above structure, due to the detachable connection between the first connecting rod unit and the second connecting rod unit through the connecting device, when the connecting rod piece needs to be mounted, the first connecting rod unit and the second connecting rod unit can be combined into one through the connecting device, and then the curtain is mounted in the first mounting slot to achieve mounting of the curtain and the connecting rod piece. When the connecting rod piece needs to be transported or stored, the curtain can be separated from the first mounting slot, and the first connecting rod unit can be separated from the second connecting rod unit, so as to reduce a length of the connecting rod, which reduces the packaging and logistics costs of the connecting rod piece during the transportation and greatly reduces the transportation cost of the connecting rod piece. Moreover, since the connecting device connects the first connecting rod unit to the second connecting rod unit, it is not only convenient for mounting and removal, but also achieves high connection strength.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
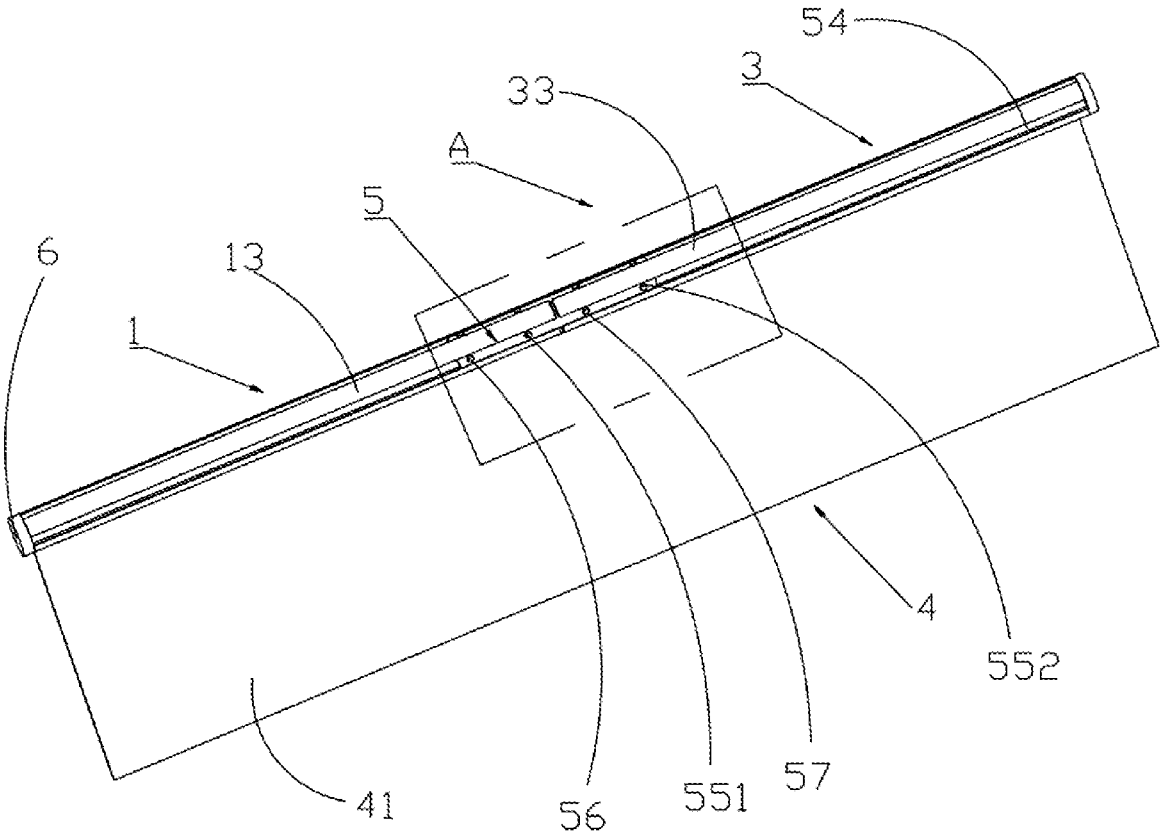
FIG. 1 is a schematic diagram of an entire structure of the present disclosure.
Figure 2:
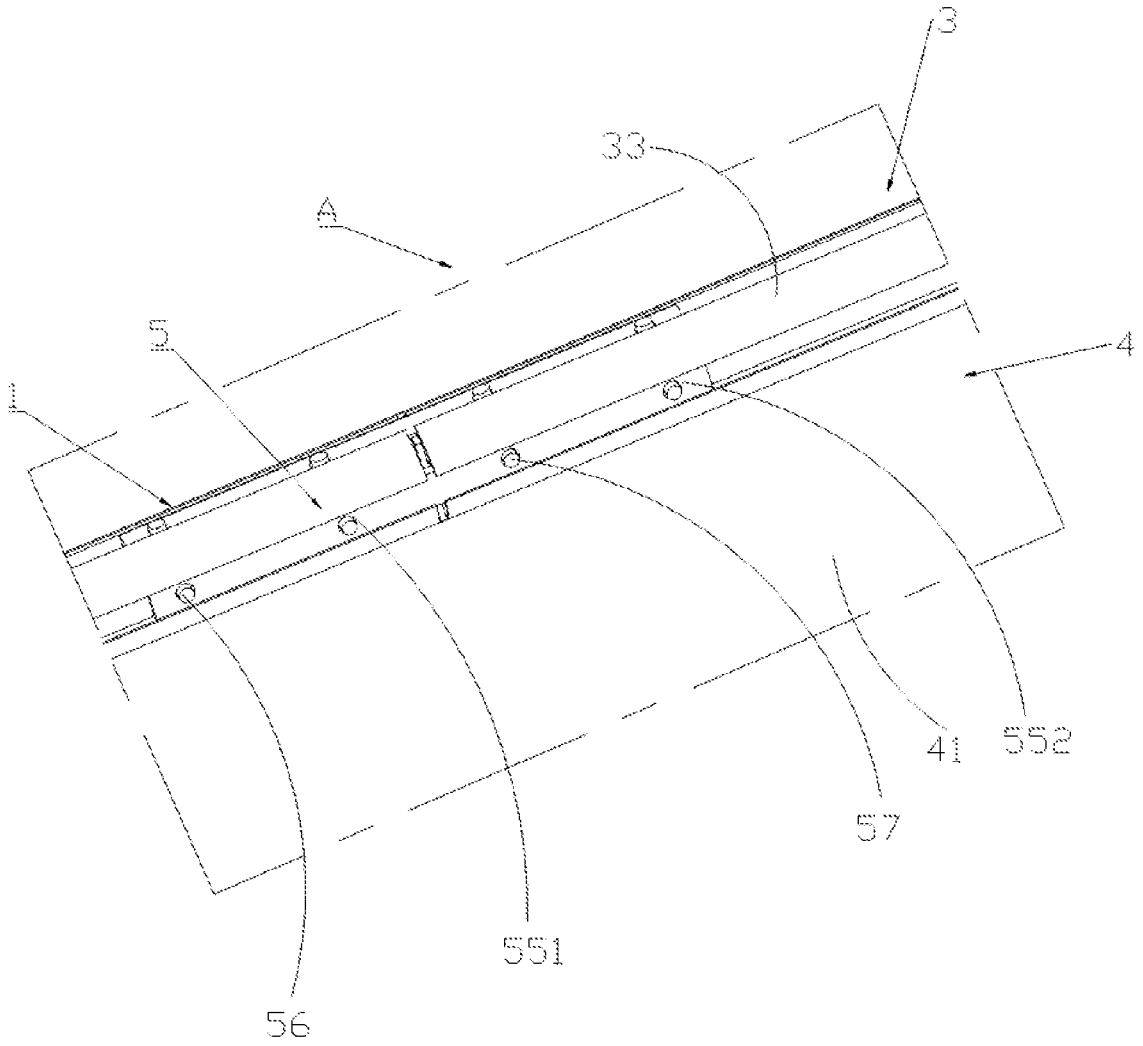
FIG. 2 is an enlarged view of the part A in FIG. 1.
Figure 3:
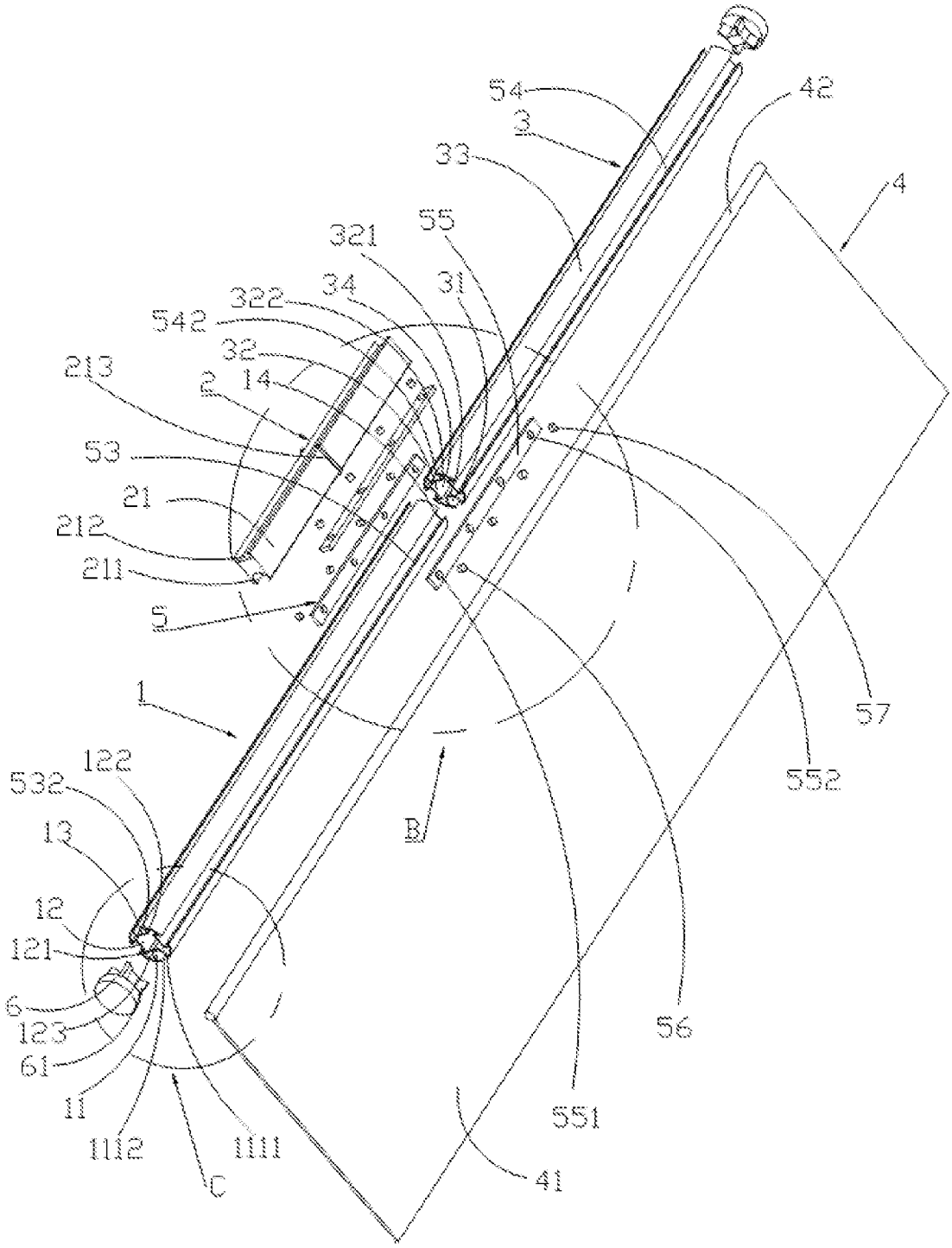
FIG. 3 is an exploded view of the present disclosure.
Figure 4:
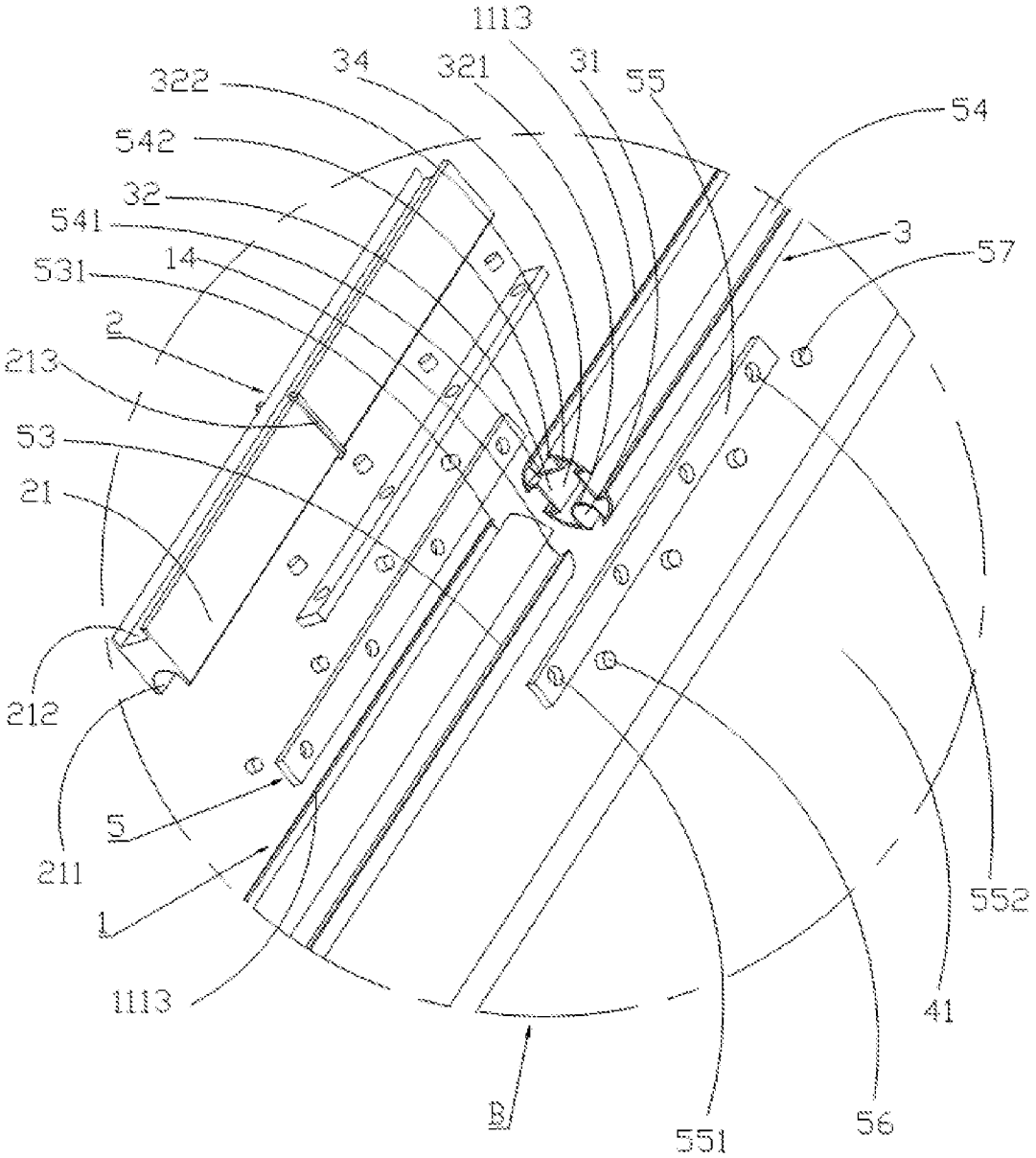
FIG. 4 is an enlarged view of the part B in FIG. 3.
Figure 5:
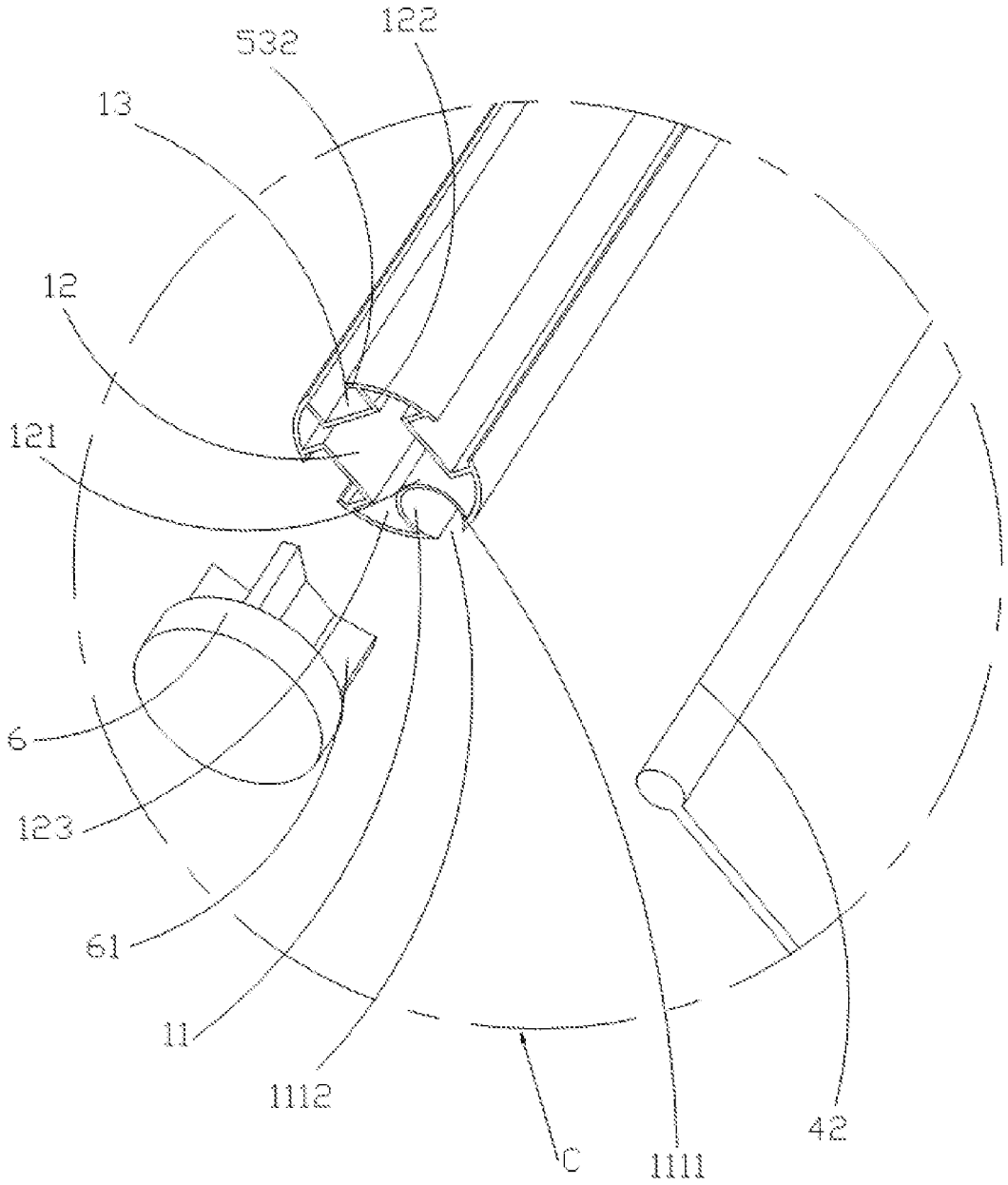
FIG. 5 is an enlarged view of the part C in FIG. 3.
Figure 6:
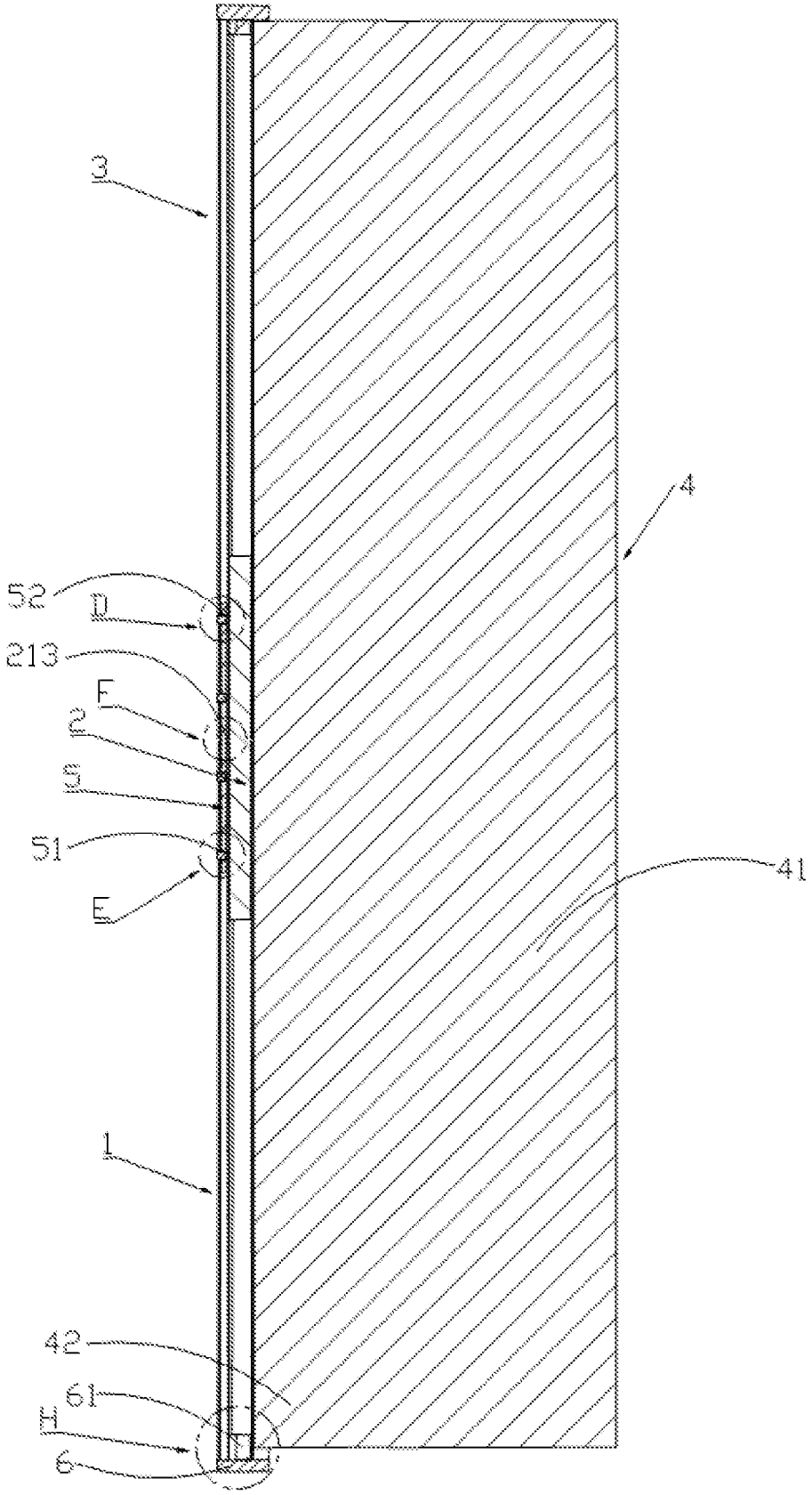
FIG. 6 is a sectional view cut away along a first connecting rod unit and a second connecting rod unit.
Figure 7:
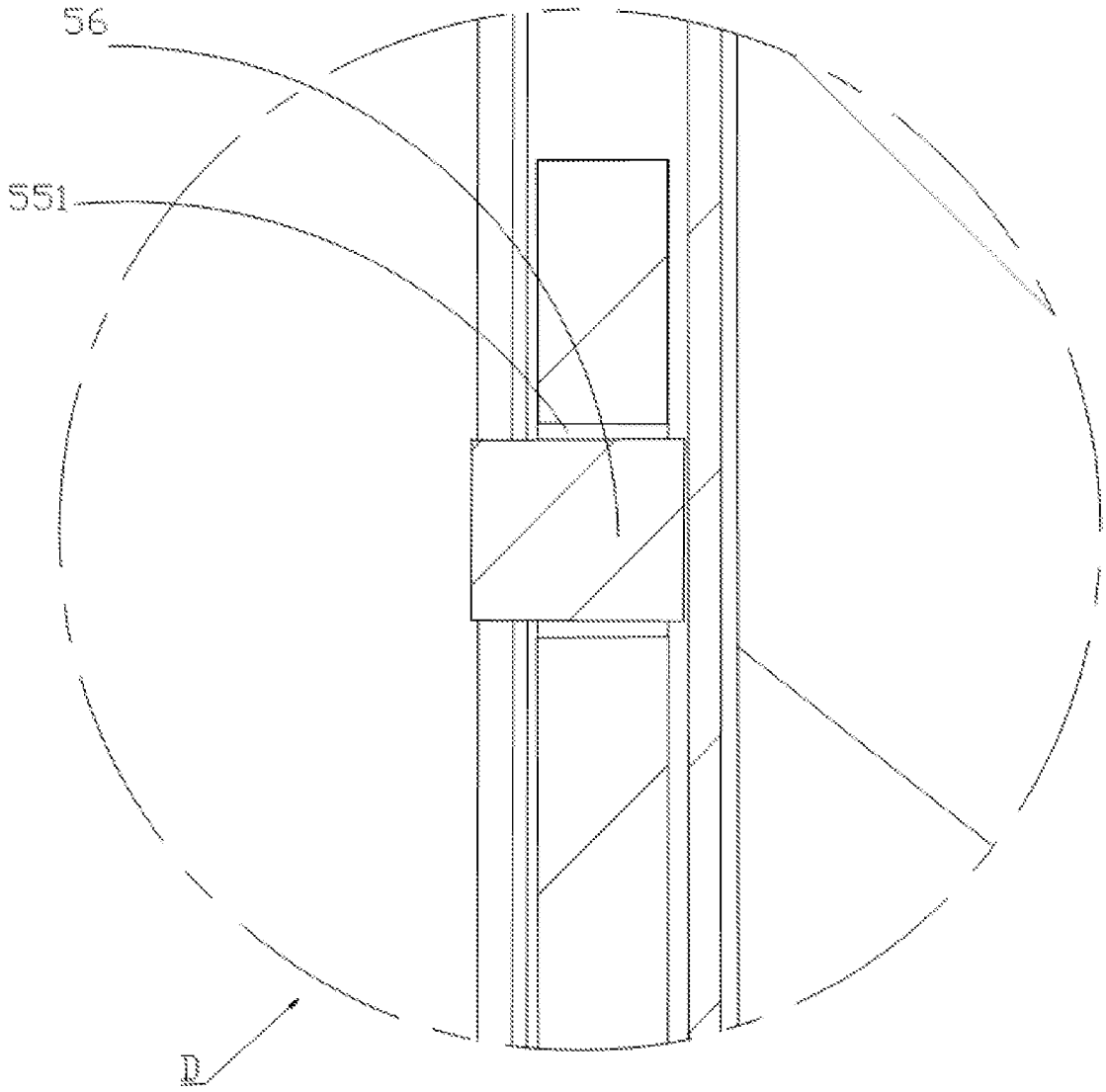
FIG. 7 is an enlarged view of the part D in FIG. 6.
Figure 8:
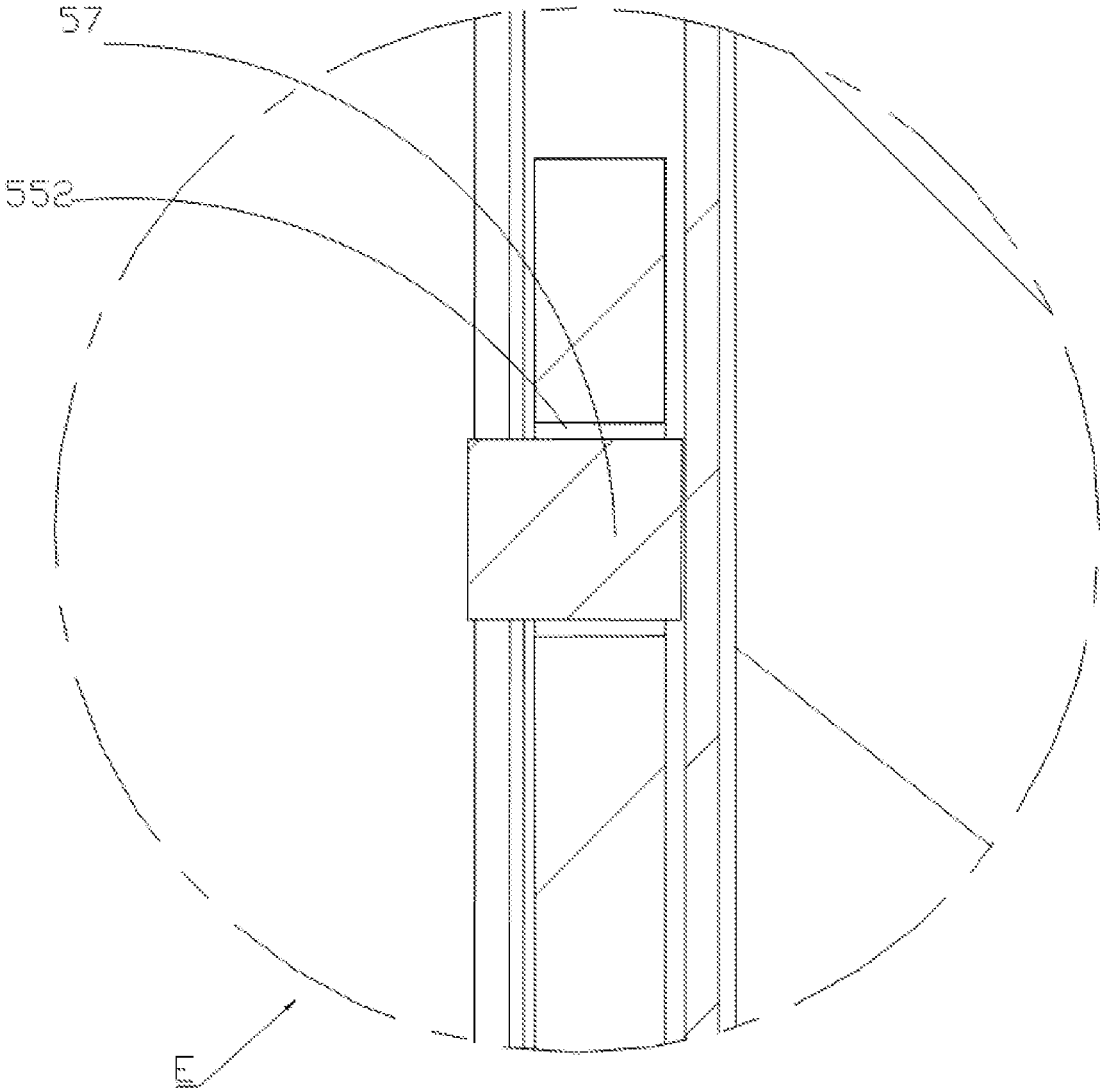
FIG. 8 is an enlarged view of the part E in FIG. 6.
Figure 9:
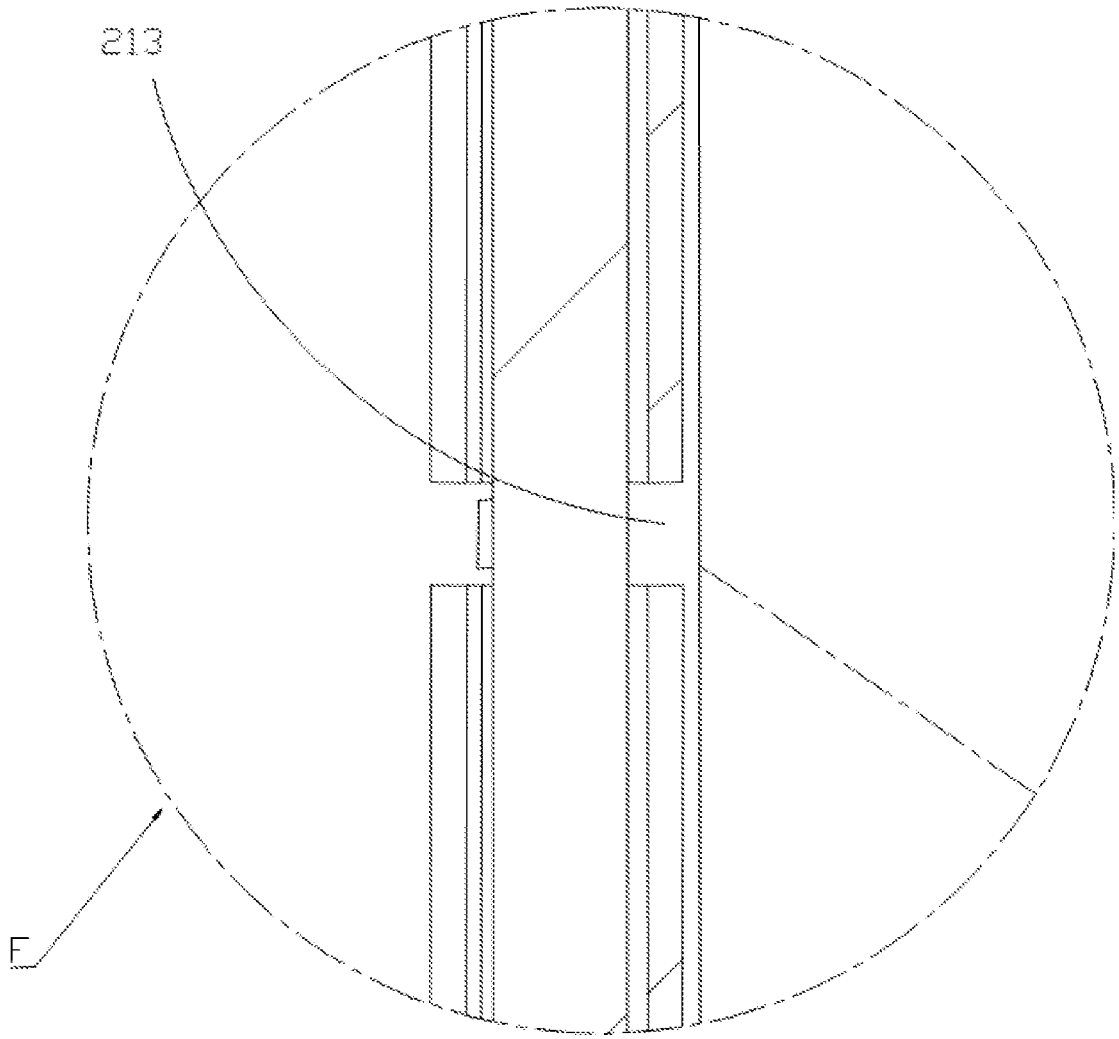
FIG. 9 is an enlarged view of the part F in FIG. 6.
Figure 10:
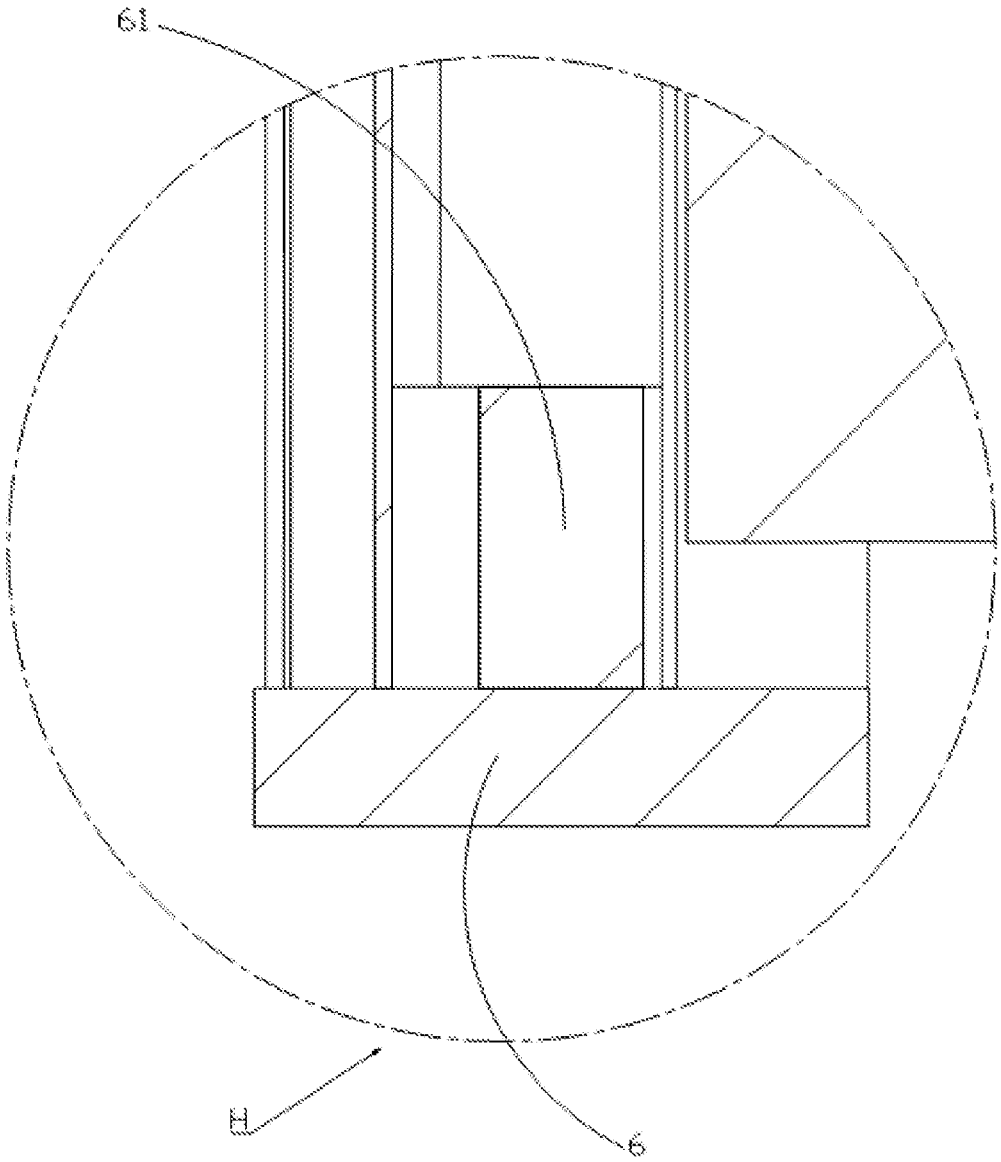
FIG. 10 is an enlarged view of the part H in FIG. 6.
Figure 11:
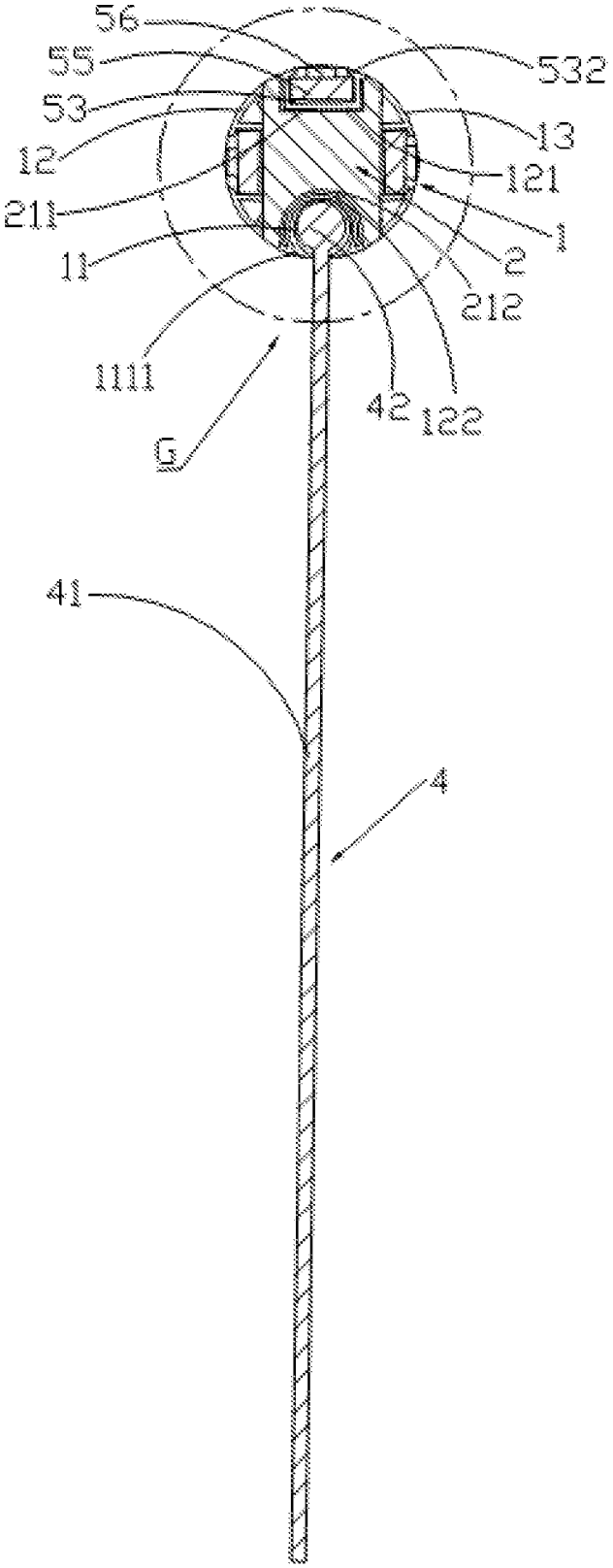
FIG. 11 is a sectional view cut away along a connecting device.
Figure 12:
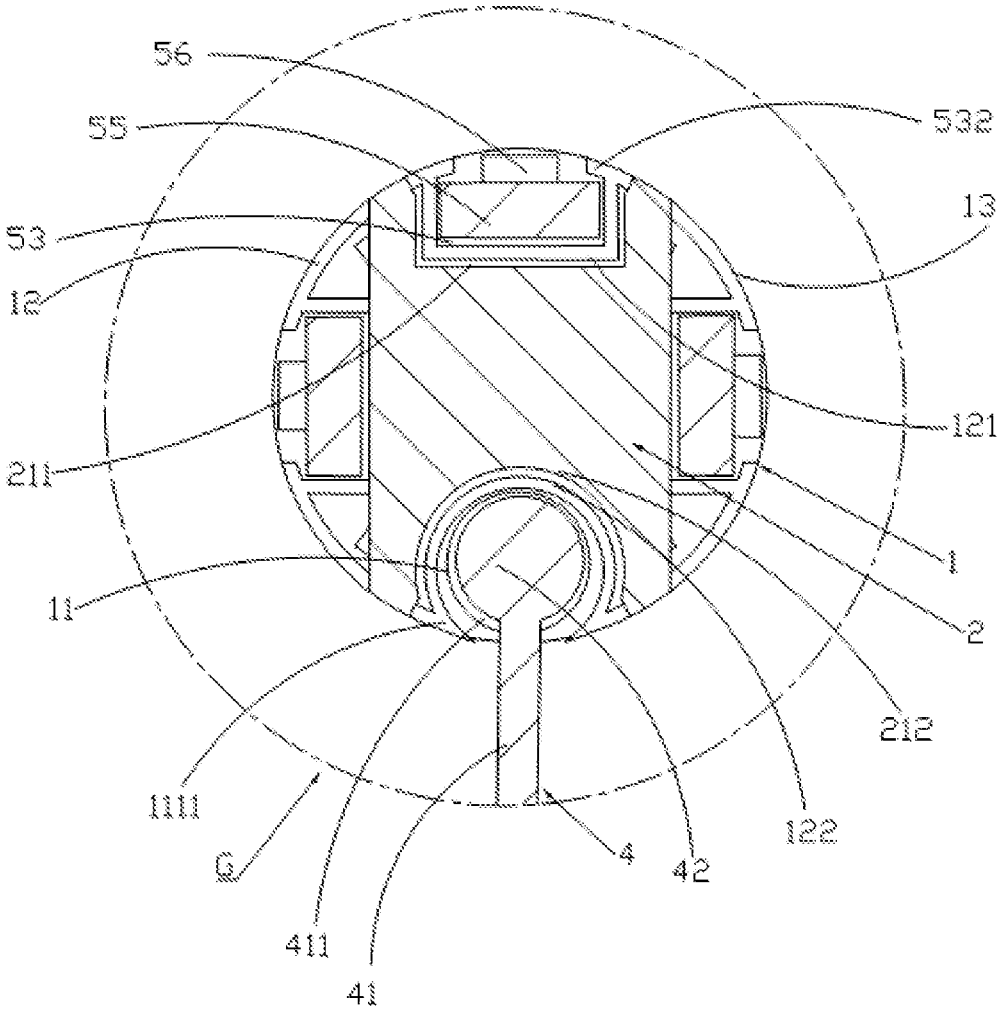
FIG. 12 is an enlarged view of the part G in FIG. 11.

Referring to FIG. 1 to FIG. 12, a connecting rod piece includes:

a hollow first connecting rod unit 1, wherein a side wall of the first connecting rod unit 1 is provided with a first mounting slot 11;

a connection device 2; and a hollow second connecting rod unit 3, wherein a side wall of the second connecting rod unit 3 is provided with a second mounting slot 31; the second connecting rod unit 3 is detachably connected to the first connecting rod unit 1 through the connecting device 2, and the first mounting slot 11 and the second mounting slot 31 are communicated in sequence to form a mounting channel; and the mounting channel is configured to mount a curtain 4.

Through the above structure, due to the detachable connection between the first connecting rod unit 1 and the second connecting rod unit 3 through the connecting device 2, when the connecting rod piece needs to be mounted, the first connecting rod unit 1 and the second connecting rod unit 3 can be combined into one through the connecting device 2, and then the curtain 4 is mounted in the first mounting slot 11 to achieve mounting of the curtain 4 and the connecting rod piece. When the connecting rod piece needs to be transported or stored, the curtain 4 can be separated from the first mounting slot 11, and the first connecting rod unit 1 can be separated from the second connecting rod unit 3, so as to reduce a length of the connecting rod, which reduces the packaging and logistics costs of the connecting rod piece during the transportation and greatly reduces the transportation cost of the connecting rod piece. Moreover, since the connecting device 2 connects the first connecting rod unit 1 to the second connecting rod unit 3, it is not only convenient for mounting and removal, but also achieves high connection strength.

In this embodiment, the first connecting rod unit 1 has a first mounting opening 14; the second connecting rod unit 3 has a second mounting opening 34; the connecting device 2 includes a connecting pipe fitting 21; and one end of the connecting pipe fitting 21 is inserted into the first mounting opening 14, and the other end of the connecting pipe fitting 21 is inserted into the second mounting opening 34, to enable the connecting pipe fitting 21 to combine the first connecting rod unit 1 with the second connecting rod unit 3 into a whole. The connecting device 2 further includes a locking member 5; and when one end of the connecting pipe fitting 21 is inserted into the first mounting opening 14, and the other end of the connecting pipe fitting 21 is inserted into the second mounting opening 34, to enable the connecting pipe fitting 21 to combine the first connecting rod unit 1 with the second connecting rod unit 3 into a whole, the first connecting rod unit 1 is locked to the second connecting rod unit 3. Specifically, the locking member 5 includes a first locking slot 53, a second locking slot 54, a locking gasket 55, a first adjustment member, and a second adjustment member; an end portion of the first locking slot 53 is provided with a first insertion port 531; an end portion of the second locking slot 54 is provided with a second insertion port 541; when one end of the connecting pipe fitting 21 is inserted into the first mounting opening 14, and the other end of the connecting pipe fitting 21 is inserted into the second mounting opening 34, to enable the connecting pipe fitting 21 to combine the first connecting rod unit 1 with the second connecting rod unit 3 into a whole, one end of the locking gasket 55 is inserted into the first locking slot 53 through the first insertion port 531, and the other end of the locking gasket 55 is inserted into the second locking slot 54 through the second insertion port 541; and the first adjustment member compresses and locks one end of the locking gasket 55 in the first locking slot 53, and the second adjustment member compresses and locks the other end of the locking gasket 55 in the second locking slot 54, so as to lock the first connecting rod unit 1 in the second connecting rod unit 3. Further, the first adjustment member includes a first adjustment screw 56 and a first adjustment screw hole 551; the second adjustment member includes a second adjustment screw 57 and a second adjustment screw hole 552; the first adjustment screw hole 551 is arranged at one end of the locking gasket 55, and the second adjustment screw hole 552 is arranged the other end of the locking gasket 55; when one end of the connecting pipe fitting 21 is inserted into the first mounting opening 14, and the other end of the connecting pipe fitting 21 is inserted into the second mounting opening 34, to enable the connecting pipe fitting 21 to combine the first connecting rod unit 1 with the second connecting rod unit 3 into a whole, one end of the locking gasket 55 is inserted into the first locking slot 53 via the first insertion port 531, and the other end of the locking gasket 55 is inserted into the second locking slot 54 through the second insertion port 541; one end of the first adjustment screw 56 moves inside the first adjustment screw hole 551 to compress an inner wall of the first locking slot 53, so that the other end of the first adjustment screw 56 compresses and locks one end of the locking gasket 55 against the inner wall of the first locking slot 53; and one end of the second adjustment screw 57 moves inside the second adjustment screw hole 552 to compress an inner wall of the second locking slot 54, so that the other end of the second adjustment screw 57 compresses and locks the other end of the locking gasket 55 against the inner wall of the second locking slot 54, so as to lock the first connecting rod unit 1 to the second connecting rod unit 3. Specifically, a quantity of the first adjustment screw hole 551 is at least two; a quantity of the second adjustment screw hole 552 is at least two; a quantity of the first adjustment screw 56 is at least two; the at least two first adjustment screws 56 are respectively arranged in the at least two first adjustment screw holes 551; a quantity of the second adjustment screw 57 is at least two; and the at least two second adjustment screws 57 are respectively arranged in the at least two second adjustment screw holes 552. The at least two first adjustment screw holes 551 and the at least two second adjustment screw holes 552 are uniformly arranged in sequence along the locking gasket 55. A quantity of first locking protrusions 51 is at least two, and a quantity of second locking protrusions 52 is at least two. Much further, the first connecting rod unit 1 has a first inner surface 12 and a first outer surface 13; the first outer surface 13 is recessed towards the first inner surface 12 to form the first mounting slot 11 and the first locking slot 53 on the first outer surface 13 and to form a first guide protrusion 121 opposite to the first mounting slot 11 and a second guide protrusion 122 opposite to the first locking slot 53 on the first inner surface 12; the second connecting rod unit 3 has a second inner surface 32 and a second outer surface 33; the second outer surface 33 is recessed towards the second inner surface 32 to form the second mounting slot 31 and the second locking slot 54 on the second outer surface 33 and to form a third guide protrusion 321 opposite to the second mounting slot 31 and a fourth guide protrusion 322 opposite to the second locking slot 54 on the second inner surface 32; the connecting pipe fitting 21 is provided with a first guide slot 211 and a second guide slot 212; the first guide slot 211 is connected to the first guide protrusion 121 and the third guide protrusion 321; and the second guide slot 212 is connected to the second guide protrusion 122 and the fourth guide protrusion 322. Through the above structure, one end of the connecting pipe fitting 21 can be inserted into the first mounting opening 14 of the first connecting rod unit 1, and the other end of the connecting pipe fitting 21 can be inserted into the second mounting opening 34 of the second connecting rod unit 3, which effectively achieves the detachable connection between the first connecting rod unit 1 and the second connecting rod unit 3. Furthermore, one end of the first adjustment screw 56 moves inside the first adjustment screw hole 551 to compress the inner wall of the first locking slot 53, so that the other end of the first adjustment screw 56 compresses and locks one end of the locking gasket 55 against the inner wall of the first locking slot 53. One end of the second adjustment screw 57 moves inside the second adjustment screw hole 552 to compress the inner wall of the second locking slot 54, so that the other end of the second adjustment screw 57 compresses and locks the other end of the locking gasket 55 against the inner wall of the second locking slot 54, so as to lock the first connecting rod unit 1 to the second connecting rod unit 3. When the first connecting rod unit 1 and the second connecting rod unit 3 need to be removed, only the first adjustment screw and the second adjustment screw need to be loosened to release the compression of the first adjustment screw and the second adjustment screw on the locking gasket, so as to release the locking between the first connecting rod unit and the second connecting rod unit. One end of the connecting pipe fitting 21 can be separated from the first mounting opening 14, and the other end of the connecting pipe 21 can be separated from the second mounting opening 34, so as to separate the first connecting rod unit 1 from the second connecting rod unit 3. This facilitates the storage and transportation of the connecting rod piece and the curtain 4. Moreover, since the first connecting rod unit 1 and the second connecting rod unit 3 are connected into a whole through the connecting pipe fitting 21 in the middle, a connection between the first connecting rod unit 1 and the second connecting rod unit 3 is higher in strength and is less prone to bending due to an external force.

The connecting pipe fitting 21 is a plastic connecting pipe fitting 21 or a metal connecting pipe fitting 21. Specifically, the first connecting rod unit 1 is a first metal connecting rod unit, and the second connecting rod unit 3 is a second metal connecting rod unit.

In this embodiment, a stop protrusion 213 is further arranged on a side wall of the connecting pipe fitting 21; one side of the stop protrusion 213 is stopped at the first mounting opening 14; and the other side of the stop protrusion 213 is stopped at the second mounting opening 34. Through the above structure, precise connection between the connecting pipe fitting 21 and the first connecting rod unit 1, as well as the second connecting rod unit 3, is effectively achieved, which prevents the connecting pipe fitting 21 from being excessively inserted into the first mounting opening 14 or the second mounting opening 34.

In this embodiment, a first stop edge 532 is arranged on the first locking slot 53; when one end of the locking gasket 55 is inserted into the first locking slot 53, the first stop edge 532 stops the locking gasket 55 in the first locking slot 53; a second stop edge 542 is arranged on the second locking slot 54; and when the other end of the locking gasket 55 is inserted into the second locking slot 54, the second stop edge 542 stops the locking gasket 55 in the second locking slot 54. Through the above structure, the design is reasonable, the structure is connected stably, and the mounting of the locking gasket 55 is effectively achieved. Specifically, the first locking slot 53 and the first mounting slot 11 both extend from one end of the first connecting rod unit 1 to the other end of the first connecting rod unit 1, and the second locking slot 54 and the second mounting slot 31 both extend from one end of the second connecting rod unit 3 to the other end of the second connecting rod unit 3.

In this embodiment, the connecting rod piece further includes the curtain 4; a third insertion port 1111 is arranged at an end portion of the first mounting slot 11 and/or an end portion of the second mounting slot 31; the curtain 4 has a shading part 41 and a mounting bar 42; the shading part 41 is connected to the mounting bar 42; the mounting bar 42 is placed into the mounting channel through the first mounting slot 11, the first guide slot 211, and the second mounting slot 31 through the third insertion port 1111 in sequence; a first avoidance notch 1112 is arranged in axial directions of the first mounting slot 11, the first guide slot 211, and the second mounting slot 31; and the first avoidance notch 1112 is configured to avoid the shading part 41. An upper side of the shading part 41 is connected to the shading part 41 after being bent to form an accommodating chamber 411, and the mounting bar 42 is arranged in the accommodating chamber 411. Specifically, the shading part 41 is a flexible shading part 41, and the mounting bar 42 is a flexible mounting bar 42. Further, the mounting bar 42 is either a silica gel mounting bar 42 or a rubber mounting bar 42. Much further, the connecting rod piece further includes an end cover 6, and the end cover 6 is detachably covered at the third insertion port 1111. Through the above structure, the mounting bar 42 of the curtain 4 can be inserted into the third insertion port 1111, and the first avoidance notch 1112 can allow the shading part 41 to slide along with the mounting bar 42 in the third insertion port 1111. After the mounting is completed, the end cover 6 is covered at the third insertion port 1111 to prevent the mounting bar 42 from sliding out of the third insertion port 1111, so as to complete the mounting of the curtain 4. Furthermore, the shading part 41 is a flexible shading part 41, and the mounting bar 42 is a flexible mounting bar 42. When transportation and storage are required, the shading part 41 and the mounting bar 42 can be folded for storage and transportation, which further reduces the transportation cost. Furthermore, when no shading is required, the flexible shading part can be rolled up; when the shading part needs to be used, the shading part is then unfolded for use. The operation is convenient, and usage requirements of a user in different scenarios can be met.

In this embodiment, a narrow slot 123 is formed between the first guide protrusion 121 and the second guide protrusion 122, and the end cover 6 is provided with a convex block 61; and when the end cover 6 is detachably covered at the third insertion port 1111, the convex block 61 is inserted into the narrow slot 123. Specifically, the end cover 6 is a plastic end cover 6 or a metal end cover 6. When the convex block 61 is inserted into the narrow slot 123, the interior of the narrow slot 123 is pushed and compressed against the convex block 61.

In this embodiment, a second avoidance notch 1113 is arranged in axial directions of the first locking slot 53 and the second locking slot 54, and the second avoidance notch 1113 is configured to avoid the first adjustment screw 56 and the second adjustment screw 57. Through the above structure, the second avoidance notch 1113 can avoid the first adjustment screw 56 and the second adjustment screw 57, so as to move the first adjustment screw 56 inside the first adjustment screw hole 551 to compress the side wall of the first connecting rod unit 1, so that the side wall of the first connecting rod unit 1 is recessed towards the connecting pipe fitting 21 to form the first locking protrusion 51, and to move the second adjustment screw 57 inside the second adjustment screw hole 552 to compress the side wall of the second connecting rod unit 3, so that the side wall of the second connecting rod unit 3 is recessed towards the connecting pipe fitting 21 to form the second locking protrusion 52.

In this embodiment, a quantity of the first locking slot 53 is at least two, and the at least two first locking slots 53 and the first mounting slot 11 are uniformly arranged in sequence in a circumferential direction around a side wall of the first connecting rod unit 1; a quantity of the second locking slot 54 is at least two, and the at least two second locking slots 54 and the second mounting slot 31 are uniformly arranged in sequence in a circumferential direction around a side wall of the second connecting rod unit 3; a quantity of the locking gasket 55 is at least two; one end of each of the at least two locking gaskets 55 is arranged in each of the at least two first locking slots 53; and the other ends of the at least two locking gaskets 55 are respectively arranged in the at least two second locking slots 54. Specifically, the quantity of the first locking slot 53 is three, the quantity of the second locking slot 54 is three, and the quantity of the locking gaskets 55 is three. One end of each of the three locking gaskets 55 is arranged in each of the three first locking slots 53, and the other ends of the three locking gaskets 55 are respectively arranged in the three second locking slots 54.

In this embodiment, cross sections of the first locking slot 53 and the second locking slot 54 are square, and cross sections of the first mounting slot 11 and the second mounting slot 31 are circular. Further, a third stop edge is arranged at the first avoidance notch 1112, and the third stop edge is configured to stop the mounting bar 42 in the first mounting slot 11 and the second mounting slot 31, to prevent the mounting bar 42 from sliding out of the first mounting slot 11 and the second mounting slot 31 through the first avoidance notch 1112.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

The invention claimed is:

1. A connecting rod piece, comprising: a hollow first connecting rod unit, wherein a side wall of the first connecting rod unit is provided with a first mounting slot; a connecting device; and a hollow second connecting rod unit, wherein a side wall of the second connecting rod unit is provided with a second mounting slot; the second connecting rod unit is detachably connected to the first connecting rod unit through the connecting device, and the first mounting slot and the second mounting slot are communicated in sequence to form a mounting channel; and the mounting channel is configured to mount a curtain;

wherein the first connecting rod unit has a first mounting opening; the second connecting rod unit has a second mounting opening; the connecting device comprises a connecting pipe fitting; and one end of the connecting pipe fitting is inserted into the first mounting opening, and the other end of the connecting pipe fitting is inserted into the second mounting opening, to enable the connecting pipe fitting to combine the first connecting rod unit with the second connecting rod unit into a whole; and wherein the connecting device further comprises a locking member; and when one end of the connecting pipe fitting is inserted into the first mounting opening, and the other end of the connecting pipe fitting is inserted into the second mounting opening, to enable the connecting pipe fitting to combine the first connecting rod unit with the second connecting rod unit into a whole, the locking member locks the first connecting rod unit to the second connecting rod unit; and wherein the locking member comprises a first locking slot, a second locking slot, a locking gasket, a first adjustment member, and a second adjustment member an end portion of the first locking slot is provided with a first insertion port; an end portion of the second locking slot is provided with a second insertion port: when one end of the connecting pipe fitting is inserted into the first mounting opening, and the other end of the connecting pipe fitting is inserted into the second mounting opening, to enable the connecting pipe fitting to combine the first connecting rod unit with the second connecting rod unit into a whole, one end of the locking gasket is inserted into the first locking slot through the first insertion port, and the other end of the locking gasket is inserted into the second locking slot through the second insertion port and the first adjustment member compresses and locks one end of the locking gasket in the first locking slot, and the second adjustment member compresses and locks the other end of the locking gasket in the second locking slot, so as to lock the first connecting rod unit in the second connecting rod unit.

2. The connecting rod piece according to claim 1, wherein the first adjustment member comprises a first adjustment screw and a first adjustment screw hole; the second adjustment member comprises a second adjustment screw and a second adjustment screw hole: the first adjustment screw hole is arranged at one end of the locking gasket, and the second adjustment screw hole is arranged the other end of the locking gasket: when one end of the connecting pipe fitting is inserted into the first mounting opening, and the other end of the connecting pipe fitting is inserted into the second mounting opening, to enable the connecting pipe fitting to combine the first connecting rod unit with the second connecting rod unit into a whole, one end of the locking gasket is inserted into the first locking slot via the first insertion port, and the other end of the locking gasket is inserted into the second locking slot through the second insertion port: one end of the first adjustment screw moves inside the first adjustment screw hole to compress an inner wall of the first locking slot, so that the other end of the first adjustment screw compresses and locks one end of the locking gasket against the inner wall of the first locking slot; and one end of the second adjustment screw moves inside the second adjustment screw hole to compress an inner wall of the second locking slot, so that the other end of the second adjustment screw compresses and locks the other end of the locking gasket against the inner wall of the second locking slot, so as to lock the first connecting rod unit to the second connecting rod unit.

3. The connecting rod piece according to claim 2, wherein the first connecting rod unit has a first inner surface and a first outer surface; the first outer surface is recessed towards the first inner surface to form the first mounting slot and the first locking slot on the first outer surface and to form a first guide protrusion opposite to the first mounting slot and a second guide protrusion opposite to the first locking slot on the first inner surface: the second connecting rod unit has a second inner surface and a second outer surface: the second outer surface is recessed towards the second inner surface to form the second mounting slot and the second locking slot on the second outer surface and to form a third guide protrusion opposite to the second mounting slot and a fourth guide protrusion opposite to the second locking slot on the second inner surface; the connecting pipe fitting is provided with a first guide slot and a second guide slot; the first guide slot is connected to the first guide protrusion and the third guide protrusion; and the second guide slot is connected to the second guide protrusion and the fourth guide protrusion.

4. The connecting rod piece according to claim 1, wherein a stop protrusion is further arranged on a side wall of the connecting pipe fitting; one side of the stop protrusion is stopped at the first mounting opening; and the other side of the stop protrusion is stopped at the second mounting opening.

5. The connecting rod piece according to claim 2, wherein a first stop edge is arranged on the first locking slot: when one end of the locking gasket is inserted into the first locking slot, the first stop edge stops the locking gasket in the first locking slot: a second stop edge is arranged on the second locking slot; and when the other end of the locking gasket is inserted into the second locking slot, the second stop edge stops the locking gasket in the second locking slot.

6. The connecting rod piece according to claim 1, wherein the first locking slot and the first mounting slot both extend from one end of the first connecting rod unit to the other end of the first connecting rod unit, and the second locking slot and the second mounting slot both extend from one end of the second connecting rod unit to the other end of the second connecting rod unit.

7. The connecting rod piece according to claim 3, further comprising the curtain, wherein a third insertion port is arranged at an end portion of the first mounting slot and/or an end portion of the second mounting slot: the curtain has a shading part and a mounting bar; the shading part is connected to the mounting bar: the mounting bar is placed into the mounting channel through the first mounting slot, the first guide slot, and the second mounting slot through the third insertion port in sequence: a first avoidance notch is arranged in axial directions of the first mounting slot, the first guide slot, and the second mounting slot; and the first avoidance notch is configured to avoid the shading part.

8. The connecting rod piece according to claim 7, wherein an upper side of the shading part is connected to the shading part after being bent to form an accommodating chamber, and the mounting bar is arranged in the accommodating chamber.

9. The connecting rod piece according to claim 7, wherein the shading part is a flexible shading part, and the mounting bar is a flexible mounting bar.

10. The connecting rod piece according to claim 7, further comprising an end cover, wherein the end cover is detachably covered at the third insertion port.

11. The connecting rod piece according to claim 10, wherein a narrow slot is formed between the first guide protrusion and the second guide protrusion, and the end cover is provided with a convex block; and when the end cover is detachably covered at the third insertion port, the convex block is inserted into the narrow slot.

12. The connecting rod piece according to claim 2, wherein a second avoidance notch is arranged in axial directions of the first locking slot and the second locking slot, and the second avoidance notch is configured to avoid the first adjustment screw and the second adjustment screw.

13. The connecting rod piece according to claim 2, wherein a quantity of the first locking slot is at least two, and the at least two first locking slots and the first mounting slot are uniformly arranged in sequence in a circumferential direction around a side wall of the first connecting rod unit: a quantity of the second locking slot is at least two, and the at least two second locking slots and the second mounting slot are uniformly arranged in sequence in a circumferential direction around a side wall of the second connecting rod unit: a quantity of the locking gasket is at least two; one end of each of the at least two locking gaskets is arranged in each of the at least two first locking slots; and the other ends of the at least two locking gaskets are respectively arranged in the at least two second locking slots.

14. The connecting rod piece according to claim 2, wherein cross sections of the first locking slot and the second locking slot are square, and cross sections of the first mounting slot and the second mounting slot are circular.

15. The connecting rod piece according to claim 1, wherein the connecting pipe fitting is a plastic connecting pipe fitting or a metal connecting pipe fitting.

16. The connecting rod piece according to claim 1, wherein the first connecting rod unit is a first metal connecting rod unit, and the second connecting rod unit is a second metal connecting rod unit.

17. The connecting rod piece according to claim 10, wherein the end cover is a plastic end cover or a metal end cover.

* * * * *